US009283972B2

(12) United States Patent
Bai et al.

(10) Patent No.: US 9,283,972 B2
(45) Date of Patent: Mar. 15, 2016

(54) NETWORKING OPERATION DISPATCH SYSTEM BASED ON ELECTRONIC ZONES FOR RAIL VEHICLE

(71) Applicants: Wei Bai, Shanxi (CN); Jing Bai, Shanxi (CN); Qing Bai, Shanxi (CN); Xianbing Bai, Shanxi (CN); Baolong Feng, Shanxi (CN)

(72) Inventors: Wei Bai, Shanxi (CN); Jing Bai, Shanxi (CN); Qing Bai, Shanxi (CN); Xianbing Bai, Shanxi (CN); Baolong Feng, Shanxi (CN)

( * ) Notice: Subject to any disclaimer, the term of this patent is extended or adjusted under 35 U.S.C. 154(b) by 0 days.

(21) Appl. No.: 14/360,624

(22) PCT Filed: Dec. 31, 2012

(86) PCT No.: PCT/CN2012/001763
§ 371 (c)(1),
(2) Date: May 26, 2014

(87) PCT Pub. No.: WO2014/032218
PCT Pub. Date: Mar. 6, 2014

(65) Prior Publication Data

US 2015/0191184 A1 Jul. 9, 2015

(30) Foreign Application Priority Data

Aug. 27, 2012 (CN) ..... 2012 1 0307124

(51) Int. Cl.
*B61L 23/26* (2006.01)
*B61L 15/00* (2006.01)
*B61L 23/30* (2006.01)
*B61L 27/00* (2006.01)

(52) U.S. Cl.
CPC ..... *B61L 23/26* (2013.01); *B61L 15/0027* (2013.01); *B61L 23/30* (2013.01); *B61L 27/0038* (2013.01)

(58) Field of Classification Search
CPC ..... B61L 23/26; B61L 23/30; B61L 27/0038; B61L 15/0027
See application file for complete search history.

(56) References Cited

U.S. PATENT DOCUMENTS

| | | | | |
|---|---|---|---|---|
| 8,514,825 | B1 * | 8/2013 | Addepalli et al. | 370/338 |
| 8,520,695 | B1 * | 8/2013 | Rubin et al. | 370/445 |
| 2009/0114114 | A1 * | 5/2009 | Rose et al. | 104/53 |
| 2009/0167513 | A1 * | 7/2009 | Hill et al. | 340/435 |
| 2010/0280751 | A1 * | 11/2010 | Breed | 701/207 |
| 2011/0061558 | A1 * | 3/2011 | Crawford et al. | 104/53 |
| 2011/0098908 | A1 * | 4/2011 | Chun | 701/117 |
| 2011/0112751 | A1 * | 5/2011 | Sethi | 701/200 |
| 2011/0184605 | A1 * | 7/2011 | Neff | 701/25 |
| 2012/0323474 | A1 * | 12/2012 | Breed et al. | 701/117 |
| 2013/0059589 | A1 * | 3/2013 | Dalsgaard et al. | 455/437 |
| 2013/0184985 | A1 * | 7/2013 | Bollars | 701/410 |

(Continued)

*Primary Examiner* — James Trammell
*Assistant Examiner* — James E Stroud

(57) ABSTRACT

A networking operation dispatch system based on electronic zones for rail vehicle comprises: a zone-end relay computer, a communication ranging antenna along rail, a locomotive-mounted response computer and a road networking computer, wherein: the zone-end relay computer is installed on an end of each electronic zone; the communication ranging antenna along rail has an equivalent length to the electronic zone, a first end of the communication ranging antenna along rail is connected with the zone-end relay computer and a second thereof is disposed in the air; the locomotive-mounted response computer is installed on each locomotive and communicates with the zone-end relay computer in the electronic zone occupied by the locomotive via the communication ranging antenna; and the road networking computer connects each zone-end relay computer to form a network. A rail security detecting sensor is provided in the electronic zone.

2 Claims, 5 Drawing Sheets

(56) References Cited

U.S. PATENT DOCUMENTS

2013/0345979 A1* 12/2013 Oostveen ..... 701/533
2014/0104081 A1* 4/2014 Cross et al. ..... 340/989
2014/0303892 A1* 10/2014 Morlock ..... 701/533
2015/0218872 A1* 8/2015 Breed

* cited by examiner a locomotive passing detection alarm device (Mi-1)

a locomotive passing detection alarm device (Mi+1)

NETWORKING OPERATION DISPATCH SYSTEM BASED ON ELECTRONIC ZONES FOR RAIL VEHICLE

CROSS REFERENCE OF RELATED APPLICATION

This is a Continuation-In-Parts application of an application having an application number U.S. application Ser. No. 13/825,262, filed on Aug. 9, 2011, which is a U.S. National Stage under 35 U.S.C 371 of the International Application PCT/CN2011/001307, filed Aug. 9, 2011, which claims priority under 35 U.S.C. 119(a-d) to CN 201110046202.6, filed Feb. 26, 2011; and of the International Application PCT/CN2012/001763, filed Dec. 31, 2012, which claims priority under 35 U.S.C. 119(a-d) to CN 201210307124.5 field Aug. 27, 2012.

BACKGROUND OF THE PRESENT INVENTION

1. Field of Invention

The present invention relates to a networking operation dispatch system for preventing rail vehicles from head-on collision and rear-ending collision.

2. Description of Related Arts

A Chinese patent application with an application number 201110046202.6 (PCT/CN2011/001307) discloses a method for improving operation density of rail vehicle and preventing mutual collision and rear-end collision. The method divides a rail line into equidistant electronic zones, the length of a zone being greater than the shortest safe distance between two running vehicles, and a locomotive passing detection alarm device is installed in each electronic zone, when a locomotive travels at a high speed on the rail, the locomotive passing detection alarm device corresponding to the zone occupied by the locomotive itself will simultaneously access adjacent front and back zones, and determine whether the two adjacent zones are simultaneously occupied by locomotives. If the two adjacent zones are simultaneously occupied by locomotives, the locomotive passing alarm device will send an alarm signal to the locomotives to warn or otherwise take measures. The aforesaid method adopts wired hardware connection of electronic components, and working thereof is processed by a logic gate circuit, whose operation is independent and offline, and information exchanges thereof are offline as well. Therefore, the method is capable of preventing mutual collision and rear-end collision and has an absolute priority. However, the method has disadvantages as follows. A fast determination method for relative distance between locomotives is not provided. The locomotive is not processed with real-time range based localization along the rail. In addition, information of locomotives running in each electronic zone cannot be exchanged and transmitted in real time, which brings great difficulties to the unified dispatch and control. Further, the method has disadvantages of insufficiently displaying of dynamic information of locomotives in road network and insufficiently providing external interference for preventing mutual collision and rear-end collision of locomotives.

SUMMARY OF THE PRESENT INVENTION

The present invention provides a networking operation dispatch system based on electronic zones for rail vehicle, so as to solve a problem of difficulties in unified dispatch and control, which exist in the method based on electronic zones for improving operation density of rail vehicle and preventing mutual collision and rear-end collision. Furthermore, the networking operation dispatch system based on electric zones for rail vehicle of the present invention is capable of achieving range based localization of locomotives in electronic zones, interconnection and intercommunication between locomotives or between the locomotive and the road network, so as to achieve an unmanned driving of the locomotives.

Accordingly, in order to solve the problems mentioned above, technical solutions adopted by the present invention are as follows.

A networking operation dispatch system based on electronic zones for rail vehicle comprises: a zone-end relay computer, a communication ranging antenna along rail, a locomotive-mounted response computer and a road networking computer, wherein:

the zone-end relay computer is installed on an end of each electronic zone;

the communication ranging antenna along rail has an equivalent length to the electronic zone, a first end of the communication ranging antenna along rail is connected with the zone-end relay computer and a second thereof is disposed in the air;

the locomotive-mounted response computer is installed on each locomotive and communicates with the zone-end relay computer in the electronic zone occupied by the locomotive via the communication ranging antenna; and the road networking computer connects each zone-end relay computer to form a network.

The present invention is an improvement to an application having an application number CN201110046202.6 (PCT/CN2011/001307) and a title "Method for improving operation density of rail vehicle and preventing mutual collision and rear-end collision". The aforementioned method disclosed is capable of definitely avoiding locomotive head-on and rear-end collision and has an absolute priority. The networking operation dispatch system of the present invention exchanges and transmits information of locomotive running in each electronic zone in real time via the zone-end relay computer and the road networking computer, processes range based localization on the locomotive along rail in the electronic zone, so as to provide convenience for operation dispatch of the locomotive, so as to provide subsidiary for preventing mutual collision and rear-end collision, and thus has a secondary priority.

A rail security detecting sensor is disposed in the electronic zone for detecting rail hardware or security operation condition, transmitting detected results to the zone-end relay computer in real time, or otherwise marking the information with geographic coordinates and uploading to the road networking computer via the zone-end relay computer. According to a detecting result, the zone-end relay computer is capable of automatically closing the electronic zone and stopping entrance of the locomotive, or otherwise uploading the detecting result added with the geographic coordinate to the road networking computer in time, so as to inform relevant units to discover and avoid potential security problems for locomotive running.

The networking operation dispatch system of the present invention marks all of the locomotives running in the road network with electronic addresses in an overall network. Each locomotive is precisely processed with range based localization along rail in corresponding electronic zone thereof Information of all locomotives in the road network is uploaded to the road networking computer via the zone-end relay computer in the electronic zone occupied by the locomotives, so as to provide great convenience for unified dispatch and control. Furthermore, the technical solution is capable of opening or closing a certain electronic zone or turnout in a long distance as well. In addition, installing other rail security detecting sensors has great significance on disaster reduction and prevention and avoiding driving accidents.

These and other objectives, features, and advantages of the present invention will become apparent from the following detailed description, the accompanying drawings, and the appended claims.

Figure 1:
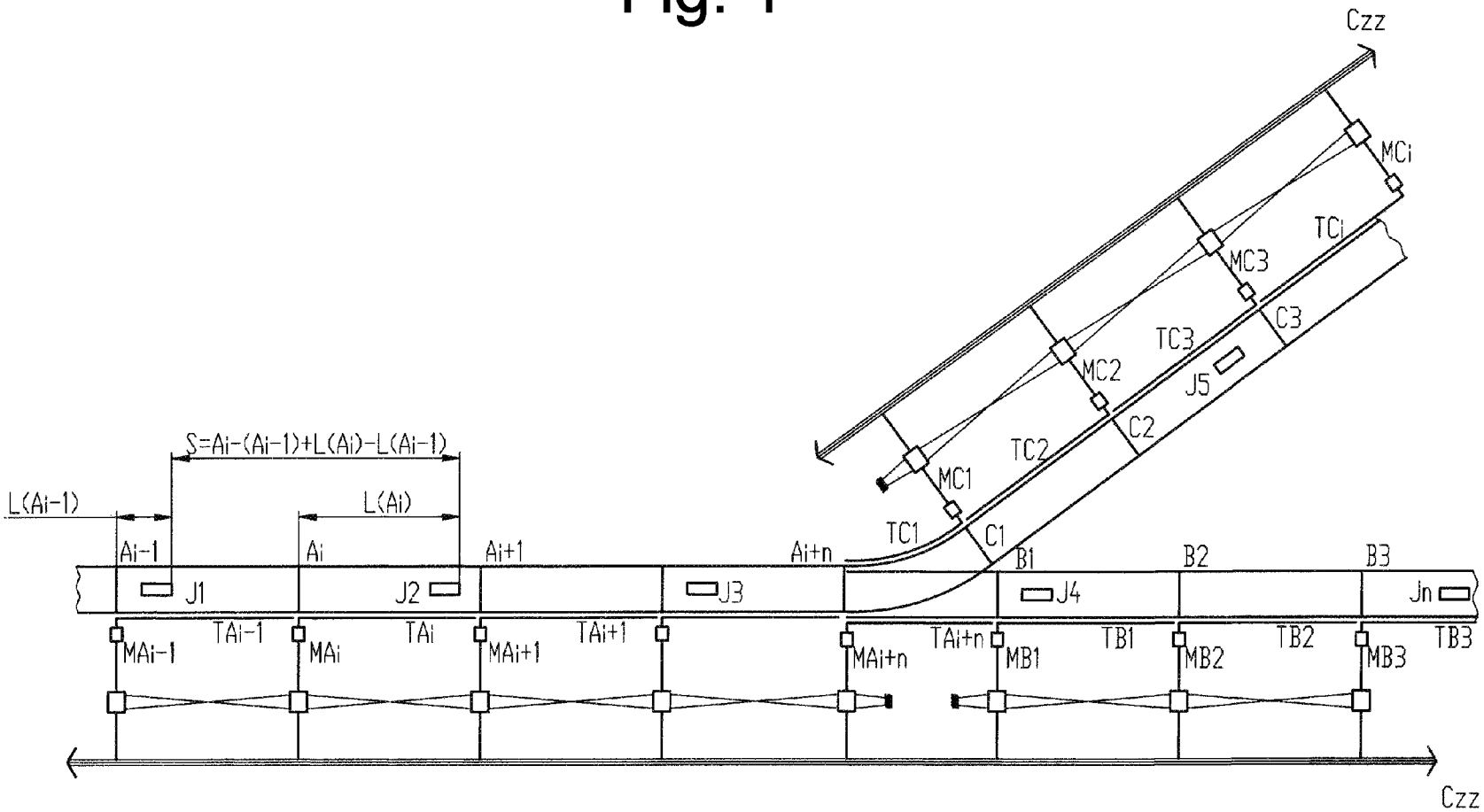
FIG. 1 is a schematic view of a networking operation dispatch system based on electronic zones for rail vehicle according to a preferred embodiment of the present invention.

In the FIG. 1, Ai, Bi, Ci . . . represent addresses of electronic zones; MAi, MBi, MCi . . . represent zone-end relay computers; MAi, MBi, MCi represent communication ranging antennas along rail; Lai, Lbi, LCi . . . represent zone distances; J1, J2, Jn . . . represent locomotive-mounted response computers; and Czz represents road networking computer.

Figure 2:
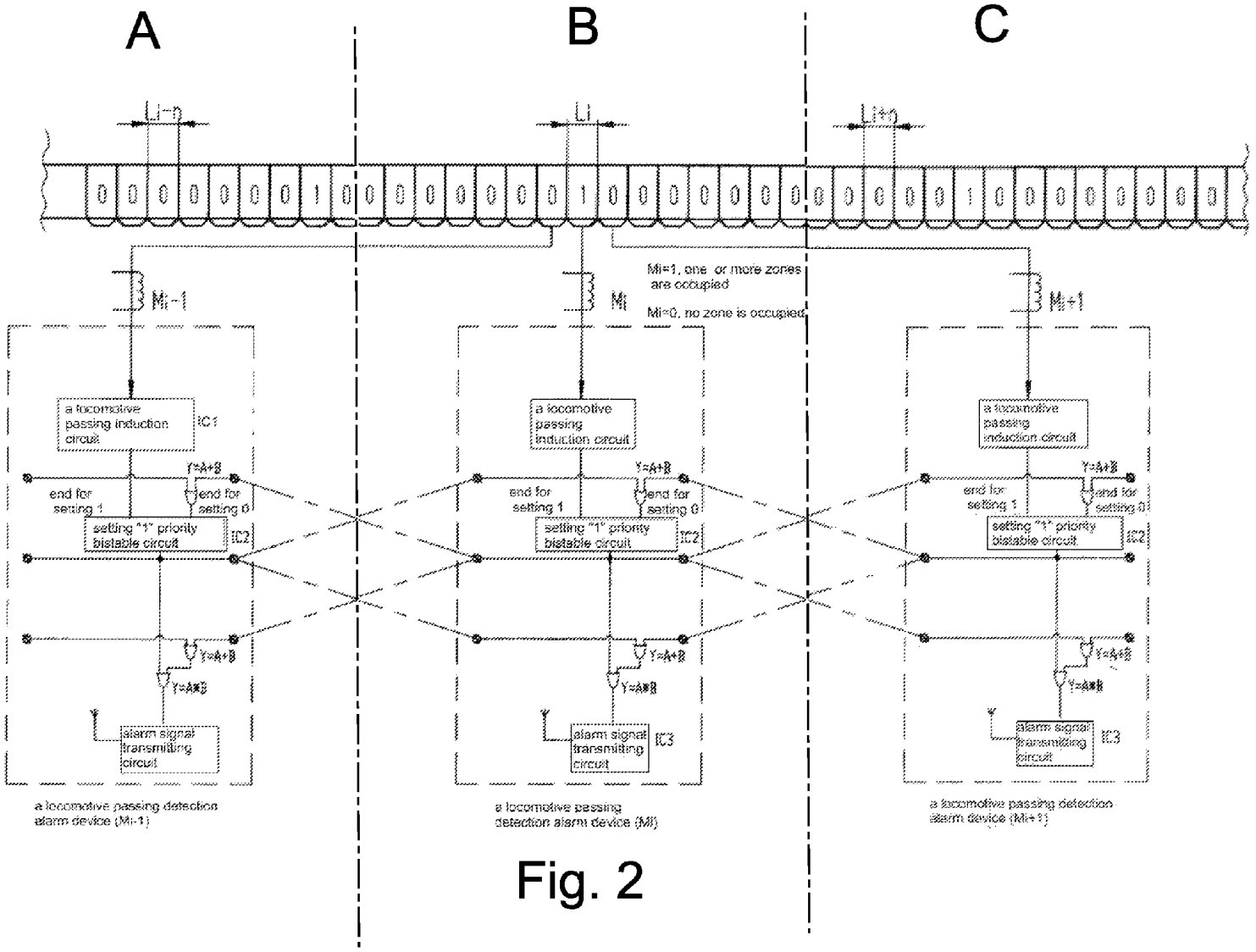

FIG. 2 is a schematic diagram of improving driving density of rail vehicles and preventing vehicle and preventing mutual collision and rear-end collision.

Figure 2A:
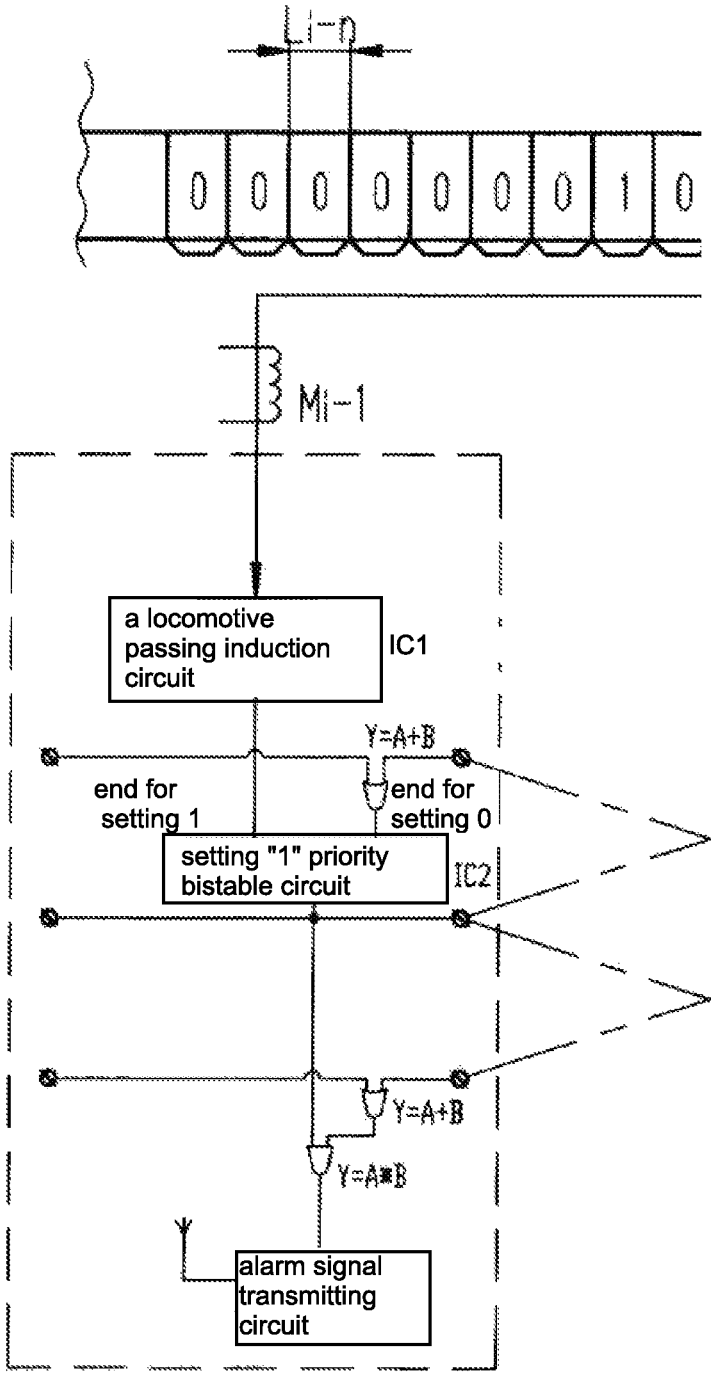

FIG. 2A is an enlarged drawing of a part A of the FIG. 2.

Figure 2B:
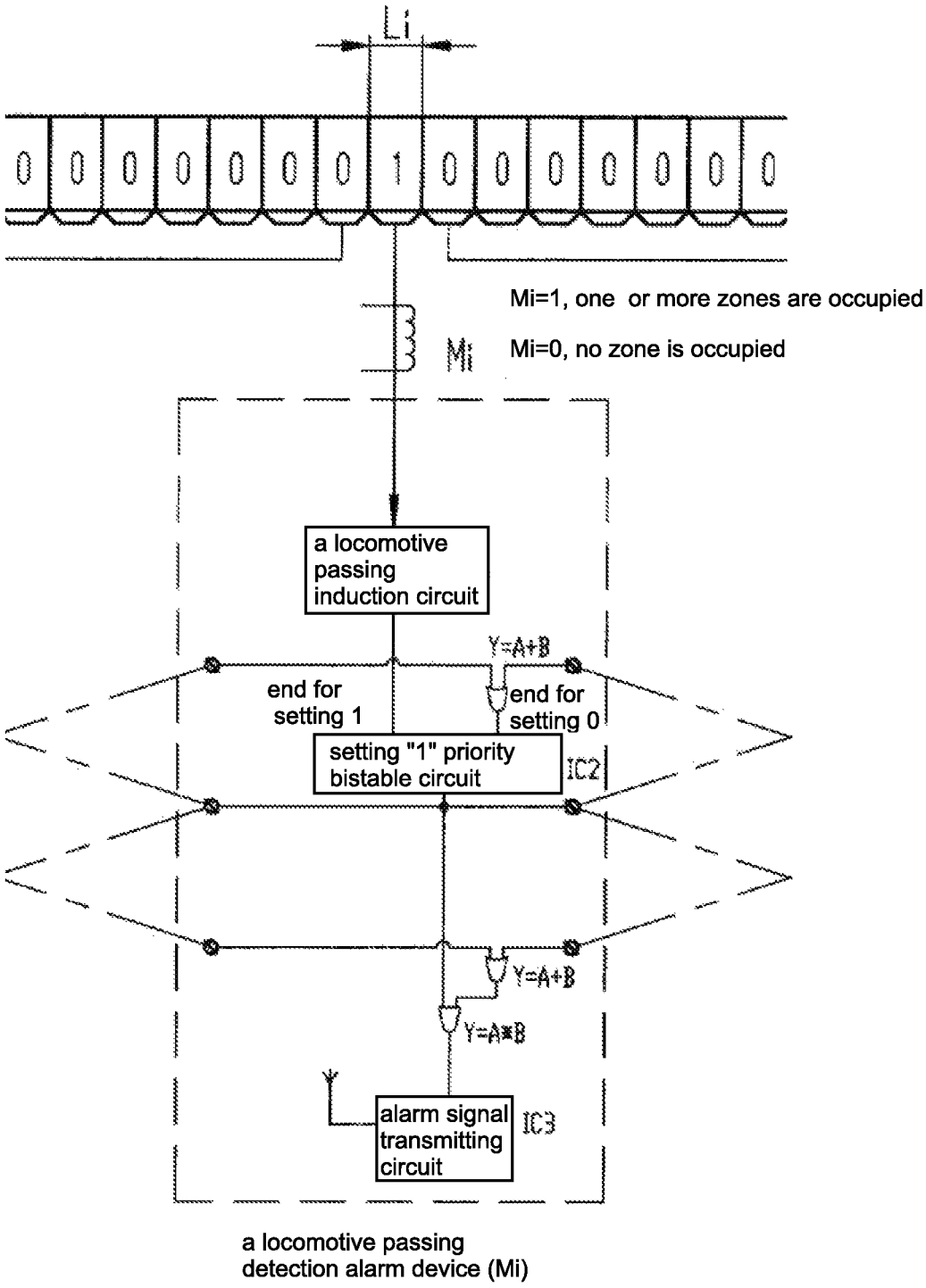

FIG. 2B is an enlarged drawing of a part B of the FIG. 2.

Figure 2C:
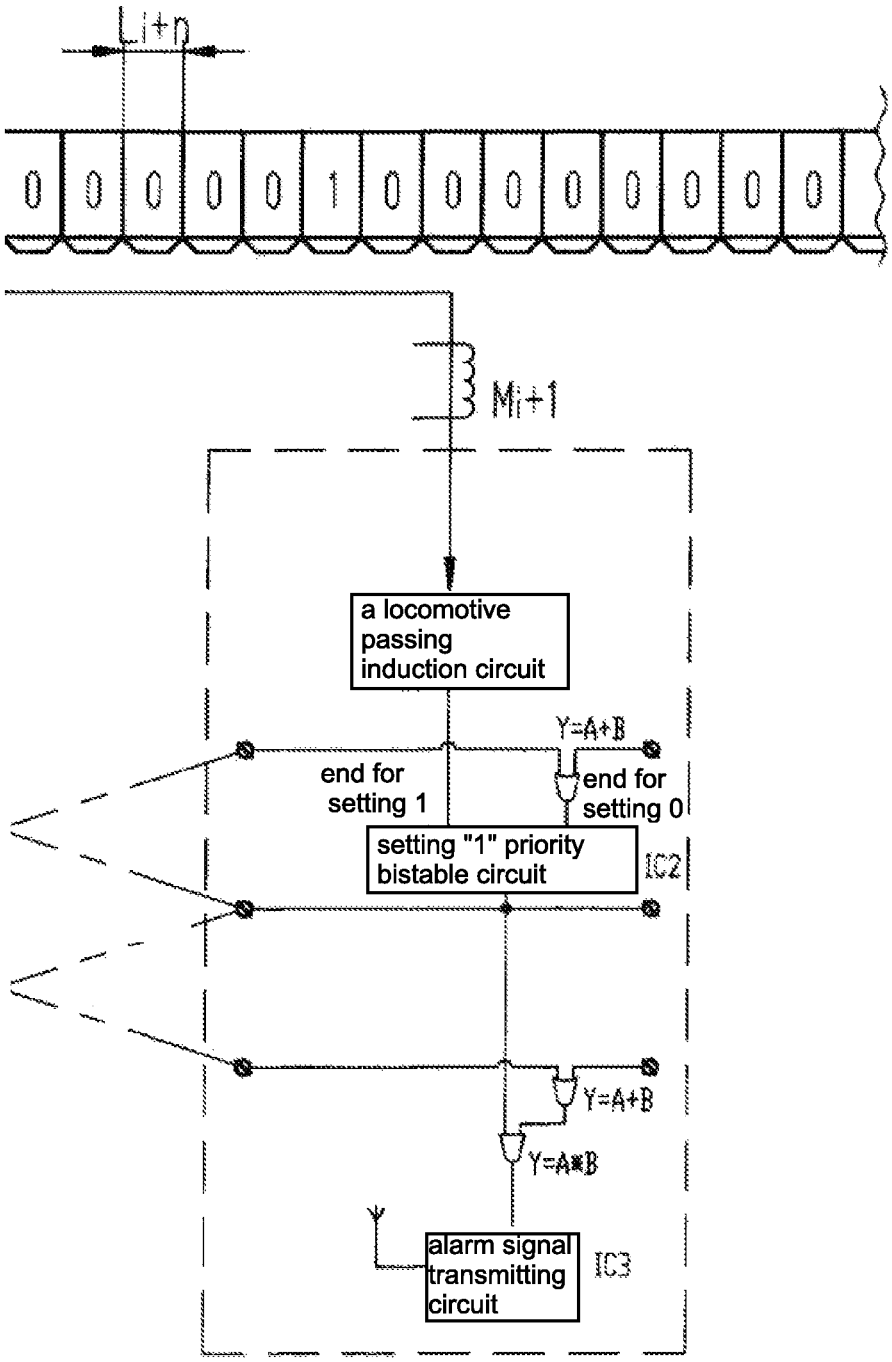

FIG. 2C is an enlarged drawing of a part C of the FIG. 2.

DETAILED DESCRIPTION OF THE PREFERRED EMBODIMENT

The present invention provides a networking operation dispatch system based on electronic zones for rail vehicle comprising: a zone-end relay computer, a communication ranging antenna along rail, a locomotive-mounted response computer and a road networking computer.

Referring to FIG. 1 of the drawing, the networking operation dispatch for rail vehicle of the present invention is based on electronic zones. In a network, each electronic zone has an address in different sections of rail, and the address is called electronic zone address (Ai, B, Ci . . . ) The electronic zone address is the one and only address. A certain electronic zone address is corresponding to one electronic zone, which actually represents a length of a rail section and is defined as "an electronic position". A plurality of electronic positions are connected in series to form "an electronic character", which actually represents a length of a range of rail connected in series by multiple sections of rail. Any electronic position can be set at a position "1" or a position "0" in the network, wherein setting "1" represents that electronic zone corresponded therewith is occupied or closed, and setting "0" represents that the electronic zone corresponded therewith is free or open. In a node of a rail turnout, 3 different addresses for the electronic zone must be named, and in practical, 3 electronic positions are occupied. The 3 electronic positions are used for representing combination condition of the rail turnout, in such a manner that the locomotive which is about to running into the turnout learns that what the combination condition of the forehand turnout is, whether the turnout is occupied or free, and that what electronic address of the rail is the turnout going to lead to. Lengths of three adjacent electronic zones which are in peripheries of the three electronic positions must meet a braking length when the locomotive is not allowed to run into the turnout. Lengths of the aforementioned three electronic zones are determined according to rail conditions or control requirements, wherein equivalent distances are not necessary, wherein the three electronic zones is defined as electronic zones for control, so as to be distinguished from electronic zones for safe driving.

The zone-end relay computers (Mai, MBi, MCi . . . ) are installed on end positions of each electronic zone. Each end of all the electronic zones has a zone-end relay computer provided thereon, and the zone-end relay computer is installed on one end of the electronic zone. Ends for installing in the electronic zone are divided into "a forward direction end" and "a reverse direction end" according to running directions, so as to distinguish two ends of the electronic zone. Each zone-end relay computer occupies one electronic zone address, which in practically represents a precise geographic coordinate position.

The communication ranging antenna along rail (TAi, TBi, TCi . . . ) has an equivalent length to the electronic zone. A first end of the communication ranging antenna along rail is connected with the zone-end relay computer and a second thereof is disposed in the air. The communication ranging antenna along rail, which has an equivalent length to the electronic zone, is lying at a short distance aside the rail. The locomotive-mounted response computer communicates with the zone-end relay computer in one electronic zone therein via the communication ranging antenna along rail. The communication ranging antenna along rail must be installed near the rail to ensure a wireless coupling communication with small gap of the locomotive in real time. The zone-end relay computer is capable of collecting and storing running information of the locomotive in the electronic zone thereof, repeating and communicating on network, sending a ranging signal to the locomotive in the electronic zone thereof. After the locomotive responses, a precise distance between the locomotive and the zone-end relay computer is obtained by measuring a length of the communication ranging antenna along rail, which is called zone distance (LAi, LBi, LCi . . . ).

The communication ranging antenna along rail is lying at a short distance along the rail, so as to ensure that a length thereof is equal to an actual traveling rail of the locomotive. When the locomotive is traveling in a certain electronic zone, the zone-end relay computer in this zone sends out a ranging signal to the locomotive via the communication ranging antenna along rail connected therewith, after the locomotive-mounted response computer receives the ranging signal, the ranging signal is marked thereby and then sent back to the zone-end relay computer via the communication ranging antenna along rail, the zone-end relay computer calculates a time of sending the ranging signal, a time of retrieving the ranging signal and a time of marking the ranging signal by the locomotive-mounted response computer, so as to obtain a transmission time of the ranging signal in the communication ranging antenna along rail, in such a manner that a length of the communication ranging antenna along rail is calculated, wherein the length of the communication ranging antenna along rail is also a distance between the locomotive and the zone-end relay computer and thus is called a zone distance. Ranging communication between the locomotive-mounted response computer and the zone-end relay computer is ensured to be transmitted back and forth on line inside the communication ranging antenna along rail, wherein a wireless coupling communication gap is at minimum, so as to decrease a deterministic transmission distance of radio waves to improve precision of ranging and locating the locomotive along rail.

The locomotive-mounted response computers (J1, J2, Jn . . . ) are mounted on each locomotive, which is also an identification card of the locomotive and has uniqueness. The locomotive communicates with the zone-end relay computer in the electronic zone occupied by the locomotive via the communication ranging antenna along rail. During operation process of the locomotive, the locomotive-mounted response computer communicates with the zone-end relay computer in the electronic zone occupied by the locomotive in real time. The locomotive-mounted response computer is installed on each locomotive and communicates with the zone-end relay computer in the electronic zone occupied by the locomotive via the communication ranging antenna. The locomotive-mounted response computer transmits running information of the electronic zone occupied by the locomotive to corresponding zone-end relay computer for storing, or otherwise switches relay continuously via the zone-end relay computer of each electronic zone, so as to maintain continuous communication with the road networking computer. After receiving the ranging signal sent by the zone-end relay computer, the locomotive-mounted response computer marks the ranging signal with precise working time, calculates running distance of the locomotive during this working time according to running speed thereof, wherein the running distance along with relevant data of locomotive combination and length thereof, positions of the locomotive and the locomotive-mounted response computer in the locomotive combination and running speed of the locomotive are all sent back to the zone-end relay computer.

The road networking computer (Czz) is connected with each zone-end relay computer to form a network. Since the zone-end relay computer installed in each electronic zone has a named electronic address, which is practically corresponded to a precise geographic coordinate position. While forming networking with the road networking computer, a wire or wireless type can be adopted according to security classification and anti-interference ability. In addition, satellite networking can be adopted as well. The road networking computer is capable of switching on/off an electronic zone or turnout in a long distance, so as to control that whether the locomotive can run into the electronic zone.

A rail security detecting sensor is disposed in the electronic zone. The rail security detecting sensor transmits information to the zone-end relay computer, marks the information with a geographic coordinate and then uploads the information with the geographic coordinate to the road networking computer via the zone-end relay computer. The rail security detecting sensor is for detecting rail deformation caused by natural disasters such as collapse or flood, or other accident potentials that do not accord with security operation condition. If conditions mentioned above happen, the rail security detecting sensor sends information to the zone-end relay computer, and then uploads the information with the geographic coordinate to the road networking computer via the zone-end relay computer.

If the zone-end relay computer receives a detecting result that hinders driving , the zone-end relay computer is capable of closing the electronic zone thereof, i.e., the electronic zone thereof is set "1". According to a principle that two adjacent electronic zones can not be occupied by locomotives at the same time, when the locomotive runs into an adjacent electronic zone ahead of or behind a closed electronic zone, the locomotive learns that a next electronic zone is closed and a stopping measure must be taken.

Combined with the accompanying drawings, principle of the networking operation dispatch system of the present invention is specifically illustrated as follows.

FIG. 1 shows a turnout node, wherein electronic addresses are allocated to three sections of rail, which are respectively Ai, Bi and Ci.

Referring to FIG. 2 of the drawings, when a locomotive Jn travels in a electronic zone, the locomotive is capable of learning that whether two adjacent zones in front and behind are occupied by other locomotive, if yes, two locomotives alarm simultaneously and directly exchange information offline via corresponding zone-end relay computers, wherein the information comprises a distance between the two locomotives, a relative velocity thereof and an early warning level of head-on collision and rear-ending collision, so as to warn a driver in tine or otherwise automatically take measures. The zone-end relay computer corresponded to the two locomotives is capable of transmitting the early warning information mentioned above combined with geographic coordinates thereof to the road networking computer.

Referring to FIG. 1 of the drawings, when two locomotives drive into adjacent electronic zones, the two locomotives alarm simultaneously and directly exchange information offline, wherein a distance between the two locomotives is obtained by calculating the electronic address and the zone distance:

$$S=L[Ai-(Ai-1)]+L(Ai)-L(Ai-1)$$

wherein Ai and Ai−1 respectively represent zone-end geographic coordinates; L[Ai-(Ai−1)] is a length of the electronic zone Ai−1; L(Ai) and L(Ai−1) are zone distances respectively corresponding to the two locomotives, wherein early warning levels of the two locomotives are obtained by calculating further according to relative velocity of the two locomotives.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A networking operation dispatch system based on electronic zones for rail vehicle, comprising: a zone-end relay computer, a communication ranging antenna along rail, a locomotive-mounted response computer and a road networking computer, wherein the zone-end relay computer is installed on an end of each electronic zone, ends of the electronic zone are divided into a forward direction end and a reverse direction end according to running directions, in addition, geographic coordinate is precisely determined;

wherein when a locomotive runs in a certain electronic zone, the locomotive learns that whether two adjacent zones in front and behind are occupied by other locomotives, if yes, two locomotives simultaneously alarm and directly exchange information offline via corresponding zone-end relay computers, so as to calculate a distance between the two locomotives, a relative velocity thereof and an early warning level, so as to warn a driver or otherwise automatically take measures for preventing the locomotive from head-on collision and rear-ending collision;

wherein the zone-end relay computer collects and stores information of locomotive passing through current zone, and relaying the information to network communication;

wherein the zone-end relay computer is capable of downloading a driving command or information from the road networking computer, and forwarding by authorization to the locomotive passing through the current zone, and wherein actually, all of the locomotives in the road network are processed with range based localization in a certain zone and further processed with subsection dispatch and control by the zone-end relay computer, in such a manner that all of the locomotives are capable of achieving an unmanned operation;

wherein the communication ranging antenna along rail has an equivalent length to the electronic zone, a first end of the communication ranging antenna along rail is connected with the zone-end relay computer and a second thereof is disposed in the air;

wherein the communication ranging antenna along rail is lying at a short distance along the rail, so as to ensure that a length thereof is equal to an actual traveling rail of the locomotive;

wherein when the locomotive is traveling in a certain electronic zone, the zone-end relay computer in this zone sends out a ranging signal to the locomotive via the communication ranging antenna along rail connected therewith, after the locomotive-mounted response computer receives the ranging signal, the ranging signal is marked thereby and then sent back to the zone-end relay computer via the communication ranging antenna along rail, the zone-end relay computer calculates a time of sending the ranging signal, a time of retrieving the ranging signal and a time of marking the ranging signal by the locomotive-mounted response computer, so as to obtain a transmission time of the ranging signal in the communication ranging antenna along rail, in such a manner that a length of the communication ranging antenna along rail is calculated, wherein the length of the communication ranging antenna along rail is also a distance between the locomotive and the zone-end relay computer and thus is called a zone distance;

wherein ranging communication between the locomotive-mounted response computer and the zone-end relay computer is ensured to be transmitted back and forth on line inside the communication ranging antenna along rail, wherein a wireless coupling communication gap is at minimum, so as to decrease a deterministic transmission distance of radio waves to improve precision of ranging and locating the locomotive along rail;

wherein the locomotive-mounted response computer is installed on each locomotive and communicates with the zone-end relay computer in the electronic zone occupied by the locomotive via the communication ranging antenna;

the locomotive-mounted response computer transmits driving information of the electronic zone occupied by the locomotive to corresponding zone-end relay computer for storing, or otherwise switches relay continuously via the zone-end relay computer of each electronic zone, so as to maintain continuous communication with the road networking computer;

after receiving the ranging signal sent by the zone-end relay computer, the locomotive-mounted response computer marks the ranging signal with precise working time, calculates driving distance of the locomotive during this working time according to driving speed thereof, wherein the driving distance along relevant data of locomotive combination and length thereof, positions of the locomotive and the locomotive-mounted response computer in the locomotive combination and driving speed of the locomotive are all sent back to the zone-end relay computer;

wherein the road networking computer connects each zone-end relay computer to form a network, in such a manner that the road networking computer is capable of switching on/off a electronic zone or turnout in a long distance.

2. The system, as recited in claim 1, wherein a rail security detecting sensor is disposed in the electronic zone, so as to detect rail deformation caused by natural disasters of collapse, windstorm or flood, or other accident potentials that do not accord with security operation condition, and transmits detected information to the zone-end relay computer, wherein the zone-end relay computer is capable of automatically closing the electronic zone and stopping entrance of the locomotive according to a detecting result, or otherwise uploading the detecting result added with the geographic coordinate to the road networking computer.

* * * * *